United States Patent [19]

Schmidt et al.

[11] Patent Number: 4,832,909

[45] Date of Patent: May 23, 1989

[54] LOW COBALT-CONTAINING MARAGING STEEL WITH IMPROVED TOUGHNESS

[75] Inventors: Michael L. Schmidt, Reading; Raymond M. Hemphill, Wyomissing, both of Pa.

[73] Assignee: Carpenter Technology Corporation, Reading, Pa.

[21] Appl. No.: 218,458

[22] Filed: Jul. 11, 1988

Related U.S. Application Data

[63] Continuation-in-part of Ser. No. 944,984, Dec. 22, 1986, abandoned.

[51] Int. Cl.[4] ..... C22C 38/08

[52] U.S. Cl. ..... 420/95; 420/96; 148/328; 148/336

[58] Field of Search ..... 420/95, 96; 148/336, 148/337, 328

[56] References Cited

U.S. PATENT DOCUMENTS

| | | | |
|---|---|---|---|
| 3,093,518 | 6/1963 | Bieber | 420/95 |
| 3,093,519 | 6/1963 | Deckert et al. | 420/95 |
| 3,132,938 | 5/1964 | Deckert et al. | 420/95 |
| 3,166,406 | 1/1965 | Floreen et al. | 420/95 |
| 3,243,285 | 3/1966 | Fragetta et al. | 420/95 |
| 3,294,527 | 12/1966 | Floreen et al. | 420/95 |
| 3,318,690 | 5/1967 | Floreen et al. | 420/94 |
| 3,359,094 | 12/1967 | Bieber et al. | 420/95 |
| 3,392,065 | 7/1968 | Bieber et al. | 420/96 |
| 3,396,013 | 8/1968 | Mihalisin | 420/95 |
| 3,453,102 | 7/1969 | Tuffnell et al. | 420/95 |
| 3,488,186 | 1/1970 | Deckert et al. | 420/95 |
| 3,532,491 | 10/1970 | Floreen et al. | 420/95 |
| 3,723,196 | 3/1973 | Murphy et al. | 420/95 |
| 4,013,458 | 3/1977 | Floreen | 420/95 |
| 4,443,254 | 4/1984 | Floreen | 420/96 |
| 4,579,590 | 4/1986 | Asayama et al. | 420/97 |

FOREIGN PATENT DOCUMENTS

| | | | |
|---|---|---|---|
| 255848 | 7/1963 | Australia | 420/95 |
| 1487202 | 5/1967 | France . | |
| 58-157950 | 9/1983 | Japan | 420/95 |
| 1355475 | 6/1974 | United Kingdom . | |
| 2167436 | 5/1986 | United Kingdom . | |

*Primary Examiner*—Deborah Yee

*Attorney, Agent, or Firm*—Dann, Dorfman, Herrell and Skillman

[57] ABSTRACT

A low cobalt maraging steel has a yield strength of at least about 240 ksi (about 1655 MPa) in the aged condition in combination with good toughness as indicated by a longitudinal Charpy V-notch impact toughness of at least aobut 20 ft-lb (about 27 J), as well as good notch ductility. The alloy contains, in weight percent, about:

| | w/o |
|---|---|
| C | 0.02 Max. |
| Ni | 15–20 |
| Mo | 0.50–4.0 |
| Co | 0.5–5.0 |
| Ti | 0.90–1.35 |
| Nb | 0.03–0.35 |
| Al | 0.3 Max. |
| B | Up to 0.015 |

The balance is essentially iron, optional additions, and the usual impurities found in commercial grades of high nickel, low carbon maraging steels. The alloy is further characterized in that the ratio %Co:%Mo is at least about 0.3 and %Ti+%Nb≧1.0.

28 Claims, No Drawings

LOW COBALT-CONTAINING MARAGING STEEL WITH IMPROVED TOUGHNESS

This is a continuation-in-part of application Ser. No. 994,984, filed on Dec. 22, 1986, now abandoned.

BACKGROUND OF THE INVENTION

This invention relates to a class of low carbon, martensitic alloys known as maraging steels and to such a maraging steel having a good combination of strength and toughness in the aged condition. The invention relates more specifically to a maraging steel containing relatively low cobalt, having a room temperature yield strength at least as good as known cobalt-containing maraging 250 steels, and also having better room temperature impact toughness than cobalt-free maraging 250 steels.

Maraging steels are a class of low carbon, nickel-iron martensitic steels which achieve high strength levels by the precipitation of intermetallic compounds in an age hardening process. Among the most commonly known maraging steels are the 18 Ni (200), 18 Ni (250), and 18 Ni (300) alloys which have the following typical composition ranges in weight percent.

| | 18 Ni (200) | 18 Ni (250) | 18 Ni (300) |
|---|---|---|---|
| Al | 0.05–0.15 | 0.05–0.15 | 0.05–0.15 |
| Ni | 17–19 | 17–19 | 18–19 |
| Mo | 3–3.5 | 4.6–5.2 | 4.6–5.2 |
| Co | 8–9 | 7–8.5 | 8.5–9.5 |
| Ti | 0.15–0.25 | 0.3–0.5 | 0.5–0.8 |
| Fe | Bal. | Bal. | Bal. |

Included with the balance (Bal.) are the usual amounts of other elements present in commercial grades of maraging steels. Here and throughout this application, percent % will be by weight, unless otherwise stated.

The strength and toughness of the above-described alloys are exemplified by the following typical values for 0.2% Yield Strength (0.2% Y.S.) and Charpy V-Notch Impact Resistance (CVN).

| | 0.2% Y.S. ksi (MPa) | CVN ft-lb (J) |
|---|---|---|
| 18 Ni (200) | 190–225(1310–1550) | 26–50(35–68) |
| 18 Ni (250) | 240–265(1655–1825) | 18–33(24–45) |
| 18 Ni (300) | 260–300(1790–2070) | 12–19(16–26) |

The above-described alloys are named for their nominal nickel content (18%) and nominal yield strength as indicated by the number in the parentheses. Hereinafter, a particular maraging alloy will be referred to with respect to its nominal yield strength only, unless otherwise noted. For example, 18 Ni (250) will be referred to as a maraging 250 alloy.

Cobalt is a desirable and frequently used element in maraging steels because it helps in providing the high strength levels achieved by such steels. Some maraging steels have at least 7–8 w/o cobalt and some ultrahigh strength grades contain up to 20 w/o cobalt. Cobalt, considered to be a strategic material, is supplied primarily from unstable third world sources. Consequently, cobalt is subject to extreme fluctuations in price and availability.

In response to the supply and cost instabilities of cobalt, so called "cobalt-free" maraging steels containing essentially no cobalt have been developed. U.S. Pat. No. 4,443,254, granted Mar. 22, 1977 to S. Floreen, relates to such a maraging steel containing up to 0.03% C., up to 0.3% Al, 17–19% Ni, 1–4% Mo, 1.25–2.5% Ti, and the balance essentially Fe. The alloy is described as having a yield strength of about 240–250 ksi (1655–1725 MPa), which is comparable to the cobalt-containing maraging 250 alloy. However, this cobalt-free maraging 250 steel leaves something to be desired with respect to toughness since it has comparatively reduced toughness as indicated by a Charpy V-notch impact resistance of only about 10–25 ft-lb (15–34 J).

Furthermore, such cobalt-free maraging 250 steels include higher levels of hardening agents such as titanium. High levels of such hardening agents impart greater strength to the alloy, but also render the material more brittle, more likely to be notch brittle, and more susceptible to stress corrosion cracking.

SUMMARY OF THE INVENTION

Accordingly, it is a principal object of this invention to provide a maraging steel with significantly reduced cobalt.

Another object of this invention is to provide such a maraging steel having a tensile strength at least as good as known cobalt-containing maraging 250 steels as well as cobalt-free maraging 250 steels.

A further object of this invention is to provide a low cobalt maraging steel which has significantly better toughness than known cobalt-free maraging 250 steels and at least as good toughness as known cobalt-containing maraging 250 steels.

A still further object of this invention is to provide a low cobalt maraging steel having notch ductility at least as good as known cobalt-containing maraging 250 steels as well as known cobalt-free maraging 250 steels.

The foregoing objects, as well as other advantages of the present invention, are achieved in large measure by a maraging steel having the following composition:

| | Broad | Intermediate | Preferred |
|---|---|---|---|
| Carbon | 0.02 Max. | 0.015 Max. | 0.005 Max. |
| Nickel | 15–20 | 15–20 | 18.00–19.00 |
| Molybdenum | 0.50–4.0 | 0.50–4.0 | 1.0–3.0 |
| Cobalt | 0.5–5.0 | 0.5–5.0 | 0.9–3.5 |
| Titanium | 0.90–1.35 | 0.90–1.35 | 1.10–1.25 |
| Niobium | 0.03–0.35 | 0.04–0.35 | 0.04–0.25 |
| Aluminum | 0.3 Max. | 0.3 Max. | 0.05–0.15 |
| Boron | Up to 0.015 | 0.0005–0.010 | 0.001–0.006 |

in which the ratio % CO: % Mo is at least 0.3 preferably 0.65–0.90 and % Ti+% Nb≧ about 1.0. Furthermore, within the stated ranges the alloy is preferably balanced such that when more than about 1.25% titanium is present, carbon is limited to not more than about 0.010%. The remainder of the alloy is essentially iron which is intended to include optional elements and the usual impurities found in commercial grades of such steels. Such elements may be present in amounts which may vary from a few hundredths of a percent up to larger amounts that do not objectionably detract from the desired properties of the composition. Thus, about 0.20 w/o max., preferably about 0.10 w/o max., each of manganese and silicon; about 0.025 w/o max., preferably about 0.005 w/o max., phosphorus; about 0.015 w/o, preferably about 0.005 w/o max., sulfur; up to about 1.0 w/o, preferably about 0.25 w/o max., chromium; up to about 0.10 w/o, preferably about 0.02 w/o max., zirconium; up to about 0.1 w/o, preferably about 0.05 w/o max., calcium; up to about 1 w/o, preferably about 0.10 w/o max., copper; up to about 2 w/o, preferably about 0.10 w.o max., tungsten; up to about 1 w/o, preferably about 0.10 w/o max., vanadium; and about 0.02 w/o max., preferably about 0.003 w/o max., nitrogen can be present.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges.

Here and throughout this application it is intended by reference to niobium to include the usual amount of tantalum found in commercially available niobium alloys used in making alloying additions of niobium to commercial alloys.

DETAILED DESCRIPTION

A minimum of about 15 w/o nickel is required in this alloy to promote the formation of an iron-nickel lath martensite when the material is quenched from the solution treatment temperature. This type of martensite is relatively strong yet tough and ductile. It contains a high density of lattice dislocations which are preferred nucleation sites for the precipitation of intermetallic compounds containing nickel-molybdenum (e.g. $Ni_3Mo$) and nickel-titanium (e.g. $Ni_3Ti$) whereby the composition achieves its high strength. The high density of the preferred nucleation sites also provides a more uniform distribution of the intermetallic precipitates during aging which in turn ensures greater ductility, toughness, and notch tensile strength of the age hardened material for a given level of hardness. Nickel also promotes stress relaxation in the martensitic microstructure, thereby reducing the susceptibility of the material to brittle failure, especially at cryogenic temperatures.

Above about 20 w/o nickel the strength and toughness of the alloy are adversely affected due to retained and/or reverted austenite. The presence of more than about 20 w/o nickel can lower the $M_s$ and $M_f$ temperatures such that at room temperature the transformation of austenite to martensite is incomplete resulting in retained austenite. A nickel level greater than about 20 w/o renders the alloy more sensitive to overaging resulting in substantial austenite reversion when exposed to prolonged or excessively high heating. Accordingly, about 15–20 w/o, preferably about 18.00–19.00 w/o, nickel is present in this composition.

At least about 0.50 w/o, preferably at least about 1.0 w/o, molybdenum is present in this alloy to promote age hardening of the iron-nickel lath martensite by combining with nickel to form nickel-molybdenum intermetallic compounds. Molybdenum also lowers the diffusion coefficients of other elements in the alloy, thereby reducing grain boundary precipitation of second phase particles during aging. Molybdenum works together with cobalt to strengthen the alloy as will be described in greater detail below.

Molybdenum in excess of about 4.0 w/o has an adverse effect on the toughness and ductility of the composition due to segregation. Therefore, no more than about 4.0 w/o, preferably no more than about 3.0 w/o, molybdenum is present to ensure a homogeneous microstructure. About 2.45–2.75 w/o molybdenum provides the best combination of toughness and strength.

Cobalt contributes to the solid solution strengthening of the alloy matrix and enhances the aging response of the alloy. Cobalt magnifies the strengthening effect of molybdenum by interacting with the molybdenum. Because of the enhanced strengthening provided by cobalt, it is a feature of this invention that lower amounts of hardening agents, such as titanium, which usually tend to be embrittling agents, can be used. The toughness and ductility of the alloy is thereby improved.

Although the benefit of using cobalt in maraging steels has been known hitherto, it is an advantage of this invention that the positive effect of cobalt is obtained with significantly lower levels of cobalt than previously utilized in cobalt-containing maraging steels. Accordingly, about 0.5–5.0 w/o, preferably about 0.9–3.5 w/o, cobalt is present in the composition. The best combination of strength and toughness is achieved with about 1.80–2.20 w/o cobalt.

Cobalt and molybdenum work together and are critically balanced to provide the combination of high strength and good toughness which is characteristic of the present alloy. The toughness of the composition is adversely affected when the ratio of % cobalt to % molybdenum is less than about 0.30. The toughness of the alloy, however, is not significantly affected for cobalt exceeding about 3.5 times the molybdenum content. Thus, a cobalt to molybdenum ratio greater than about 3.5 would unnecessarily increase the cost of the alloy. Accordingly, within the ranges described above, the ratio of cobalt to molybdenum should be at least about 0.30 and preferably no greater than about 3.5. For best results the cobalt/molybdenum ratio should be about 0.65–0.90.

A relatively small but essential amount of titanium is present in this alloy because of its significant contribution to the strength of the age hardened material. Titanium combines with nickel to form stable nickel-titanium compounds, for example $Ni_3Ti$ and NiTi. The formation of such intermetallic compounds depletes the martensitic matrix of nickel thereby inhibiting austenite reversion when the alloy is overaged. A minimum of about 0.90 w/o, preferably at least about 1.10 w/o titanium, is therefore present in the alloy to achieve the desired strength and to assure sufficient formation of the nickel-titanium precipitates.

Titanium in excess of about 1.35 w/o adversely affects the ductility and toughness of the alloy. More than about 1.35 w/o titanium may result in the formation of undesirable phases such as Laves phase (e.g., $Fe_2Ti$). Such phases when present have an adverse effect on ductility and toughness. In the present invention titanium is, therefore, limited to no more than about 1.35 w/o and preferably to no more than about 1.25 w/o. The best combination of strength and toughness is achieved with about 1.20 w/o titanium.

A minimum of about 0.03%, preferably at least about 0.04% niobium is present in this alloy to provide the high hardness and strength which are characteristic of this alloy. Niobium is limited to about 0.35% max. because too much niobium adversely affects the ductility and toughness of the alloy. Better yet niobium is limited to about 0.25% max., and preferably to not more than about 0.20%.

A small but effective amount of boron, for example, at least about 0.0005%, preferably at least about 0.001% can be present in this alloy to benefit the stress corrosion cracking resistance of the alloy. When present, boron is limited to about 0.015% max. because too much boron adversely affects the strength and ductility of the alloy. Better yet boron is limited to about 0.010% max., and preferably to not more than about 0.006%. For best results, boron is limited to about 0.005% max.

Aluminum when used as a deoxidizer can be present in an amount up to about 0.3 w/o. When present, aluminum is believed to promote increased strength in the alloy because it induces aging of the Fe-Ni lath microstructure. Aluminum in excess of about 0.3 w/o is believed to adversely affect the ductility and toughness of the material both before and after aging. Preferably, about 0.05–0.15 w/o aluminum is present in the alloy to provide additional strength without a significant decrease in toughness.

Other elements may be present in the alloy as incidental additions in amounts which do not objectionably detract from the desired properties. In this regard, about 0.20 w/o maximum, preferably about 0.10 w/o maximum, manganese; up to about 1.0 w/o, preferably about 0.25 w/o maximum, chromium; up to about 0.10 w/o, preferably about 0.02 w/o maximum, zirconium; up to about 1 w/o, preferably about 0.10 w/o maximum, copper; up to about 2 w/o, preferably about 0.10 w/o maximum, tungsten; and up to about 1 w/o, preferably about 0.10 w/o maximum, vanadium may be present as hardening agents. Furthermore, about 0.20 w/o maximum, preferably about 0.10 w/o maximum, silicon and/or up to about 0.1 w/o, preferably about 0.05 w/o maximum, calcium may be present as deoxidizers.

The balance of the alloy according to the present invention is iron except for the usual impurities found in commercial grades of maraging alloys. However, the levels of such impurity elements must be controlled so as not to adversely affect the desired properties of the present alloy. In this regard, carbon and nitrogen are limited in this alloy because they combine with titanium to form undesirable carbides, nitrides and carbonitrides (e.g., TiC, TiN, and TiCN) which adversely affect both the strength and toughness of the alloy. Accordingly, carbon is limited to about 0.02 w/o maximum, better yet to about 0.015% max., and preferably to about 0.005 w/o maximum. For best results carbon is limited to about 0.002% max. Nitrogen is limited to a maximum of about 0.02% and preferably to about 0.003% max. Phosphorus is limited to about 0.025 w/o maximum, preferably about 0.005 w/o maximum and sulfur is limited to about 0.015 w/o maximum, preferably about 0.005 w/o maximum. For best results the combined level of phosphorus and sulfur is limited to a maximum of about 0.030 w/o, preferably about 0.010 w/o maximum.

The alloy according to this invention may be prepared using conventional, well known techniques. The preferred commercial practice is to melt the alloy in the vacuum induction melting (VIM) furnace and then cast the molten alloy in the form of electrodes. The electrodes are then remelted in an electroslag remelting (ESR) furnace or preferably in the vacuum arc remelting (VAR) furnace and recast into ingots or other desired forms. For applications in which high purity is not required, the alloy can be melted in an electric arc furnace, refined using the known argon-oxygen decarburization (AOD) practice, and then cast into electrodes as before. The electrodes may be remelted using ESR or VAR.

The present alloy is readily hot worked by known techniques. Prior to hot working the recast metal is homogenized at about 2150–2300 F. (about 1180–1260 C.) for up to 24 hours, followed by air cooling. Hot working is carried out from a suitable temperature in the range of about 1900–2100 F. (about 1035–1150 C.) depending on the hot working technique used.

The alloy is solution treated at about 1450–1750 F. (about 790–950 C.) for up to 1 hour followed by air cooling to near room temperature and then age hardened at about 850–930 F. (about 450–500 C.) for 3–9 hours, preferably 5 hours, followed by cooling in air. When thus prepared and aged, the alloy has a 0.2% yield strength of at least about 240 ksi (1655 MPa) and longitudinal Charpy V-Notch impact toughness of at least about 20 ft-lb (about 27 J) when prepared from large, commercial size ingots.

It is well known that alloy segregation occurs unavoidably in large cast/wrought commercial heats and that such segregation adversely affects mechanical properties such as strength and toughness. The amount of segregation present in small laboratory size heats is not as severe as in large, production size heats. Thus significantly higher yield strength and Charpy V-notch impact strength are obtainable in such small heats. The segregation problem associated with large, cast/wrought commercial heats of this alloy can be controlled by preparing the alloy using powder metallurgy techniques.

EXAMPLES

Four heats having compositions in weight percent as shown in Table I were prepared by vacuum melting. Examples 1 and 2 are alloys within the scope of the present invention. Example A is a cobalt-free grade of maraging 250 steel and Example B is a cobalt-containing maraging 250 steel.

TABLE I

| El. | Ex. 1 | Ex. 2 | Ex. A | Ex. B |
|---|---|---|---|---|
| C | 0.001 | 0.004 | 0.001 | 0.001 |
| Ni | 18.44 | 18.67 | 18.85 | 18.57 |
| Mo | 2.56 | 2.62 | 3.00 | 4.88 |
| Co | 1.49 | 2.01 | <0.01 | 7.83 |
| Ti | 1.12 | 1.24 | 1.43 | 0.44 |
| Cb | 0.11 | 0.11 | 0.01 | 0.01 |
| Al | 0.05 | 0.092 | 0.06 | 0.07 |
| B | 0.0029 | 0.0025 | 0.0031 | 0.0025 |
| Fe | Bal. | Bal. | Bal. | Bal. |

Included with the balance (Bal.) were incidental elements and impurities including: <0.02 w/o manganese, <0.01 w/o silicon, <0.005 w/o each of phosphorus and sulfur, <0.01 w/o chromium, <0.001 w/o zirconium, <0.02 w/o copper, <0.003 w/o nitrogen, and <0.002 w/o oxygen.

The vacuum melted heats were cast into electrodes which were subsequently vacuum arc remelted into 8 in. (20.3 cm) round ingots. The ingots were homogenized at about 2300 F. (1260 C.) for 15 hours and cooled to about 2050 F. (1121 C.). Each ingot was then hot worked from 2050 F. (1121 C.) into a $4\frac{3}{4}$ in. (12.1 cm) square billet and air cooled. The billets were then each reheated to and hot worked from 2050 F. (1121 C.) into $2\frac{1}{2}$ in. by $3\frac{1}{2}$ in. (6.35 cm by 8.9 cm) bars and air cooled to near room temperature.

Longitudinal test specimen blanks were cut from the bars and solution treated at 1500 F. (815 C.) for 1 hour followed by air cooling. The solution treated blanks were rough machined into tensile, notched tensile, Charpy V-notch impact, and plane strain fracture toughness test specimens. All of the rough machined test specimens were aged at 900 F. (482 C.) for 5 hours and air cooled, after which they were finish machined.

The results of room temperature tensile tests on the specimens of the four examples including 0.2% offset yield strength (0.2% Y.S.) and ultimate tensile strength (U.T.S.) given in ksi (MPa), the percent elongation in four diameters (El. %), and reduction in area (R.A. %) for each of the examples are shown in Table II. The results given in Table II are the averages of three tests except as otherwise noted.

TABLE II

| | 0.2% Y.S. ksi (MPa) | U.T.S. ksi (MPa) | El. % | R.A. % |
|---|---|---|---|---|
| Ex. 1 | 251.3 (1732.7) | 257.9 (1778.2) | 12.5 | 63.0 |
| Ex. 2 | 257.6* (1776.1) | 266.0* (1834.0) | 11.2* | 63.5* |
| Ex. A | 265.5 (1830.6) | 274.8 (1894.7) | 11.7 | 57.6 |
| Ex. B | 264.5 (1823.7) | 271.1 (1869.2) | 12.2 | 64.6 |

*Average of two tests.

Table II shows that the alloy of the present invention has a yield strength greater than about 245 ksi (about 1690 MPa) in the aged condition, comparable to both the cobalt-containing maraging 250 steel, Example B, and the cobalt-free maraging 250 steel, Example A. Moreover, the present alloy has the good ductility of the cobalt-containing maraging 250 steel, Example B, which is as good as to slightly better than that of the cobalt-free grade, Example A.

The results of room temperature notched tensile tests on the specimens of the four examples are shown in Table III. Included in Table III are the notched tensile strength (N.T.S.) given in ksi (MPa) and the ratio of N.T.S. to U.T.S. (see Table II) which is a measure of the notch ductility or notch sensitivity of the material. Notch ductility improves as the N.T.S./U.T.S. ratio increases. The N.T.S. values given in Table III are the averages of three tests except as otherwise noted.

TABLE III

| | N.T.S.* ksi (MPa) | N.T.S./U.T.S. |
|---|---|---|
| Ex. 1 | 390.4 (2691.7) | 1.51 |
| Ex. 2 | 402.5** (2775.1) | 1.51 |
| Ex. A | 405.3 (2794.4) | 1.47 |
| Ex. B | 406.4 (2802.0) | 1.50 |

*Based on a stress concentration factor, $K_t$, of 8.
**Average of two tests.

The data in Table III show that the present alloy, Examples 1 and 2, has notch ductility which is slightly better than the cobalt free maraging 250 grade, Example A, and at least as good as the cobalt-containing maraging 250 grade.

The results of room temperature Charpy V-notch impact and plane strain fracture toughness tests on respective longitudinal specimens are given in Table IV. The Charpy V-notch impact resistance values (CVN) given in ft-lb (J) are the averages of three tests while the plane strain fracture toughness values (Fract. Tough.) given in ksi $\sqrt{in}$ (MPa $\sqrt{m}$) are the averages of two tests.

TABLE IV

| | CVN ft-lb (J) | Fract. Tough.* ksi $\sqrt{in.}$ (MPa $\sqrt{m}$) |
|---|---|---|
| Ex. 1 | 37.3 (50.6) | 137.3 (150.8) |
| Ex. 2 | 32.3 (43.8) | 136.9 (150.4) |
| Ex. A | 25.3 (34.3) | 113.0 (124.2) |
| Ex. B | 27.0 (36.6) | 127.4 (140.2) |

*Tests performed in accordance with ASTM E-399 standard test.

Table IV shows a significant improvement in the longitudinal impact toughness and fracture toughness exhibited by the present invention over the cobalt-free maraging 250 alloy. The data also show that the present alloy has better toughness and has at least as good as to slightly better fracture toughness than the cobalt-containing maraging 250 grade.

In view of the foregoing detailed description and examples, the maraging alloy of the present invention clearly combines the advantage of being relatively insensitive to fluctuations in the price and supply of cobalt with a good combination of strength and ductility comparable to the higher cobalt-containing maraging 250 alloy. Moreover, the present alloy has longitudinal impact toughness and fracture toughness which are better than the cobalt-free and at least as good as the higher cobalt-containing grades of maraging 250 steels. The maraging alloy of the present invention is ideally suited for use in critical aircraft and aerospace applications where both high strength and good toughness are required. Examples of articles in which the present alloy would be useful include, in addition to billets, bars, rods and sheet, solid propellant rocket motor cases, load cells for measuring thrust, pivots for the support mechanisms in trans-stage missile engines, flexible drive shafts for helicopters, landing gear components, hinges for swing-wing aircraft, and mid-fan drive shafts for jet engines.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A maraging steel alloy having a good combination of toughness and strength in the aged condition, said alloy consisting essentially of, in weight percent, about

| | |
|---|---|
| Carbon | 0.02 Max. |
| Nickel | 15–20 |
| Molybdenum | 0.50–4.0 |
| Cobalt | 0.5–5.0 |
| Titanium | 0.90–1.35 |
| Niobium | 0.03–0.35 |
| Aluminum | 0.3 Max. |
| Boron | Up to 0.015 |

and the balance essentially Iron, wherein the ratio % Co:% Mo is at least about 0.3 and % Ti+% Nb $\geqq$1.0.

2. An alloy as recited in claim 1 containing not more than about 0.015% max. carbon.

3. An alloy as recited in claim 1 containing at least about 0.04 w/o niobium.

4. An alloy as recited in claim 3 containing at least about 0.0005 w/o boron.

5. An alloy as recited in claim 4 containing not more than about 0.010% max. boron.

6. An alloy as recited in claim 5 containing not more than about 0.25% niobium.

7. An alloy as recited in claim 1 containing not more than about 0.2 w/o max. manganese and not more than about 0.2 w/o max. silicon.

8. An alloy as recited in claim 1 containing at least about 0.9 w/o cobalt.

9. An alloy as recited in claim 8 containing not more than about 3.5 w/o max. cobalt.

10. An alloy as recited in claim 9 containing about 1.0–3.0 w/o molybdenum and wherein the ratio % Co:% Mo is about 3.5 max.

11. An alloy as recited in claim 9 wherein the ratio % Co: % Mo is about 0.65–0.90.

12. A maraging steel alloy having a good combination of strength and toughness in the aged condition, said alloy consisting essentially of, in weight percent, about

| | |
|---|---|
| Carbon | 0.005 Max. |
| Nickel | 18.00–19.00 |
| Molybdenum | 1.0–3.0 |
| Cobalt | 0.9–3.5 |
| Titanium | 1.10–1.25 |
| Niobium | 0.03–0.25 |
| Aluminum | 0.05–0.15 |
| Boron | 0.006 Max. |

and the balance essentially Iron, wherein the ratio % Co:% Mo is about 0.30–3.5.

13. An alloy as recited in claim 12 containing not more than about 0.002% max. carbon.

14. An alloy as recited in claim 12 containing at least about 0.04 w/o niobium.

15. An alloy as recited in claim 13 containing at least about 0.001 w/o boron.

16. An alloy as recited in claim 15 containing not more than about 0.004% boron.

17. An alloy as recited in claim 16 containing not more than about 0.20% max. niobium.

18. An alloy as recited in claim 12 containing about 0.10 w/o max. manganese and about 0.10 w/o max. silicon.

19. An alloy as recited in claim 12 containing about 1.80–2.20 w/o cobalt.

20. An alloy as recited in claim 19 containing about 2.45–2.75 w/o molybdenum.

21. An alloy as recited in claim 20 wherein the ratio of cobalt to molybdenum is about 0.65–0.90.

22. An age hardened article having a good combination of toughness and strength, said article formed of an alloy consisting essentially of, in weight percent, about

| | |
|---|---|
| Carbon | 0.02 Max. |
| Nickel | 15–20 |
| Molybdenum | 0.50–4.0 |
| Cobalt | 0.5–5.0 |
| Titanium | 0.90–1.35 |
| Niobium | 0.03–0.35 |
| Aluminum | 0.3 Max. |
| Boron | Up to 0.015 |

and the balance essentially Iron, wherein the ratio % Co:% Mo is at least about 0.3, and % Ti +% Nb$\geqq$1.0.

23. An article as recited in claim 22 containing about 0.9–3.5 w/o cobalt.

24. An article as recited in claim 23 containing at least about 0.04% niobium.

25. An article as recited in claim 24 containing at least about 0.0005% boron.

26. An article as recited in claim 23 containing about 1.0–3.0 w/o molybdenum and having a ratio of cobalt to molybdenum up to about 3.5.

27. An article as recited in claim 22 containing about 1.80–2.20 w/o cobalt.

28. An article as recited in claim 27 containing about 2.45–2.75 w/o molybdenum and having a cobalt to molybdenum ratio of about 0.65–0.90.

* * * * *